US006170689B1

(12) United States Patent
Flesher et al.

(10) Patent No.: US 6,170,689 B1
(45) Date of Patent: Jan. 9, 2001

(54) COLLAPSIBLE CONTAINER

(75) Inventors: Robert W. Flesher, Baltimore; Kevin J. Barnes, Uniontown; Michael Monteleone, Reisterstown, all of MD (US)

(73) Assignee: Apogee Designs, Ltd., Baltimore, MD (US)

( * ) Notice: Under 35 U.S.C. 154(b), the term of this patent shall be extended for 0 days.

(21) Appl. No.: 09/464,748

(22) Filed: Dec. 16, 1999

(51) Int. Cl.[7] ..... B65D 6/16

(52) U.S. Cl. ..... 220/7; 220/1.5; 220/4.31; 220/4.33; 220/6; 220/605; 206/508; 206/509; 206/511; 206/512; 229/122.24

(58) Field of Search ..... 220/DIG. 25, 1.5, 220/4.31, 4.33, 6, 7, 605, 611; 206/600, 508, 509, 511, 512; 229/122.23, 122.24

(56) References Cited

U.S. PATENT DOCUMENTS

| | | | | |
|---|---|---|---|---|
| Re. 32,344 | | 2/1987 | Wind | 206/599 |
| 1,185,069 | * | 5/1916 | Curry et al. | 220/4.31 |
| 1,622,525 | * | 3/1927 | Lemon | 229/122.24 |
| 1,671,051 | * | 5/1928 | Soderquist | 220/6 |
| 1,967,506 | * | 7/1934 | Harrison | 220/6 |
| 2,246,097 | * | 6/1941 | Illges | 229/122.23 |
| 2,896,798 | | 7/1959 | Celley | 214/10 |
| 3,217,965 | | 11/1965 | Macie | 229/6 |
| 3,360,180 | * | 12/1967 | Venturi | 220/6 |
| 3,514,030 | | 5/1970 | Carroll | 229/23 |
| 3,770,186 | | 11/1973 | Kupersmit | 229/23 R |
| 3,935,943 | * | 2/1976 | Meyer et al. | 229/125.015 |
| 3,968,895 | * | 7/1976 | Barnes, Jr. et al. | 220/1.5 |
| 4,177,907 | * | 12/1979 | Funaioli et al. | 220/1.5 |
| 4,254,873 | | 3/1981 | Cook, III et al. | 206/599 |
| 4,413,737 | | 11/1983 | Wind | 206/599 |
| 4,480,748 | | 11/1984 | Wind | 206/386 |
| 4,497,408 | * | 2/1985 | Jes | 206/509 |
| 4,580,680 | | 4/1986 | Wind | 206/386 |
| 4,662,515 | | 5/1987 | Newby, Sr. | 206/349 |
| 4,735,331 | | 4/1988 | Keenan et al. | 220/6 |
| 4,757,913 | | 7/1988 | Yerman | 220/345 |
| 4,809,851 | | 3/1989 | Oestreich, Jr. et al. | 206/599 |
| 4,917,255 | | 4/1990 | Foy et al. | 220/4 F |
| 4,998,637 | * | 3/1991 | Marovskis | 220/1.5 |
| 5,253,763 | | 10/1993 | Kirkley et al. | 206/600 |
| 5,398,834 | | 3/1995 | Umiker | 220/6 |
| 5,562,224 | * | 10/1996 | Pascla et al. | 220/6 |
| 5,667,065 | | 9/1997 | Fahrion | 206/599 |
| 5,809,904 | | 9/1998 | Darby | 108/55.3 |
| 5,829,595 | * | 11/1998 | Brown et al. | 220/1.5 |
| 5,862,931 | | 1/1999 | Cox et al. | 220/6 |
| 5,975,413 | * | 11/1999 | Moen | 148/671 |

* cited by examiner

*Primary Examiner*—Paul T. Sewell
*Assistant Examiner*—Troy Arnold
(74) *Attorney, Agent, or Firm*—Sterne, Kessler, Goldstein & Fox P.L.L.C.

(57) ABSTRACT

A collapsible container includes a substantially rectangular plastic base, a first plastic wall coupled by a first hinge to a first edge of the base, and a second plastic wall coupled by a second hinge to a second edge of the base opposite the first edge of the base. A first corrugated element is folded to form a first corrugated floor portion and a first corrugated wall portion, wherein the first corrugated floor portion is attached to the base so that the first corrugated wall portion is positioned between and adjacent to the first and second plastic walls. The first corrugated wall portion mates with a first lip of the first plastic wall and a first lip of the second plastic wall. Similarly, a second corrugated element is folded to form a second corrugated floor portion and a second corrugated wall portion, wherein the second corrugated floor portion is attached to the base so that the second corrugated wall portion is positioned between and adjacent to the first and second plastic walls, and opposite said first corrugated wall portion. The second corrugated wall portion mates with a second lip of the first plastic wall and a second lip of the second plastic wall. When the container is in a collapsed position, the first and second corrugated wall portions are folded in toward the base, and the first and second plastic walls are folded in toward the base and over the folded-in first and second corrugated wall portions.

26 Claims, 13 Drawing Sheets

COLLAPSIBLE CONTAINER

BACKGROUND OF THE INVENTION

1. Field of the Invention

This invention is directed to a collapsible container of the type that is maneuvered using a fork lift.

2. Related Art

Conventional storage and shipping containers consist of a wooden pallet upon which rests a corrugated cardboard box. Typically, the cardboard box component of such conventional containers is disposed of after a single use. This occurs for many reasons. First, if access to an item within such a box is required when the box is either stacked or stored on a shelf, the box is typically cut with a razor knife, which ruins the structural integrity of the box (and often ruins the item(s) within the box). Second, such cardboard boxes are not easily collapsed and are therefore inefficient to transport when empty. Further, even if they can be collapsed, when the cardboard boxes are large, as they typically are, they are awkward to handle in their collapsed position.

There have been various attempts to provide improved collapsible containers. However, the collapsible containers in the prior art are often difficult to collapse, and even more difficult to change from a collapsed position to all open (i.e., non-collapsed) position. Furthermore, the collapsible containers in the prior art typically include internal reinforcement structures that reduce the storage volume of the container. Additionally, the prior art collapsible containers often include removable parts that can be easily lost, rendering the containers useless. Other shortcomings of prior art collapsible containers are that they can be heavy, difficult and/or expensive to manufacture, and can include internal projections that can damage the item(s) stored within the containers.

What is needed is a collapsible container that is easy to collapse and easy to open from the collapsed position. The collapsible container should also be relatively easy and inexpensive to manufacture. Further, there is a need for a collapsible container that does not have removable components that can be lost. Additionally, the collapsible container should include no internal projections that can damage stored items. Still further, the collapsible container should be able to be easily and efficiently transported when collapsed.

SUMMARY OF THE INVENTION

The present invention is a collapsible container. The container includes a substantially rectangular plastic base, a first plastic wall coupled by a first hinge to a first edge of the base, and a second plastic wall coupled by a second hinge to a second edge of the base that is opposite the first edge of the base. The container also includes a first corrugated element folded to form a first corrugated floor portion and a first corrugated wall portion. The first corrugated floor portion is attached to the base so that the first corrugated wall portion is positioned between and adjacent to the first and second plastic walls. The first corrugated wall portion mates with a first lip of the first plastic wall and a first lip of the second plastic wall. A second corrugated element is folded to form a second corrugated floor portion and a second corrugated wall portion. The second corrugated floor portion is attached to the base such that the second corrugated wall portion is positioned between and adjacent to the first and second plastic walls and is opposite the first corrugated wall portion. The second corrugated wall portion mates with a second lip of the first plastic wall and a second lip of the second plastic wall.

When the container is in a collapsed position, the first and second corrugated wall portions are folded in towards the base, and the first and second plastic walls are folded in toward the base and over the folded-in first and second corrugated wall portions.

In one embodiment, the first corrugated element and the second corrugated element are formed from a single sheet of corrugated material, which can be made of, for example, plastic or cardboard. In such an embodiment, the first corrugated floor portion and the second corrugated floor portion are contiguous.

In an alternative embodiment, the first corrugated element and the second corrugated element are formed from separate sheets of corrugated material. The first corrugated floor portion in this embodiment is adjacent to the second corrugated floor portion. Further, in this embodiment, preferably the first corrugated element and the second corrugated element are substantially identical and thus interchangeable.

In one embodiment the first and second corrugated elements are attached to the plastic base by one or more plastic rivets.

In one embodiment, the plastic base, the first plastic wall, and the second plastic wall are manufactured from a single sheet of material. In this embodiment the first and second hinges are integrally formed, flexible, living hinges. Further, in this embodiment the plastic base and the first and second plastic walls are preferably thermoformed.

In a preferred embodiment, each of the first and second plastic walls includes a slot in each distal corner. A lever is pivotally attached to each distal corner of the corrugated wall portions, such that each lever can pivotally engage a corresponding slot in one of the plastic walls. When the levers engage the slots they secure the corrugated wall portions to that adjacent plastic walls.

The collapsible container preferably includes a removable lid that can rest along an outer peripheral edge of the opened container. The removable lid can also cover the container in the collapsed position. Importantly, if one or more lid covered containers in the collapsed position are stored outside, the lids keep the corrugated elements dry.

In one embodiment, where the lid includes ribs to increase its strength and rigidity, an outer rib can form a well on an upper surface of the lid. One or more drain holes can be formed in the well to allow rain water to drain out of the well in situations where the container is stored outside in the collapsed position. This will keep the corrugated elements from getting wet. In one embodiment, a surface of the well is slightly slanted to ensure that rain water drains through the drain hole(s).

In a preferred embodiment, the first plastic wall includes a first pair of bumps, one near each corner proximal to the first hinge, and the second plastic wall includes a second pair of bumps, one near each corner proximal to the second hinge. When the container is in the open position, the first and second pairs of bumps protrude in a direction outward from an interior of the container. When the container is in the collapsed position, the first pair of bumps and the second pair of bumps extend in a direction outward from an inner surface of the base. This allows four detents in an underside of a removable lid (the detents substantially align with the first and second pair of bumps) to rest, at least partially, over the first and second pair of bumps when the container is in the collapsed position. In this embodiment, the second pair of bumps preferably extend a greater distance from the second plastic wall than the first pair of bumps extend from the first plastic wall so that the second pair of bumps and the first pair of bumps are substantially planer when the container is in the closed position and the second plastic wall is folded in prior to the first plastic wall.

An advantage of the present invention is that the collapsible container is easy to collapse and easy to open from the collapsed position.

Another advantage of the present invention is that the collapsible container is easy and inexpensive to manufacture and can be manufactured from a minimal amount of materials.

Another advantage of the present invention is that the container can be made as strong, rigid and reusable as desired by increasing the thickness of the plastic base and walls and/or the corrugated elements.

A further advantage of the present invention is that the collapsible container has no (or minimal) removable components that can be lost.

Yet another advantage of the present invention is that the collapsible container includes no internal projections that can damage stored items.

Additionally, the collapsible container of the present invention can be easily and efficiently transported in the collapsed position or the open position.

A portion of the container of the present invention is preferably thermoformed and another portion of the container is made of corrugated material. This results in a container that is less expensive than a container that is completely thermoformed. This also results in a container that is stronger and lighter in weight than a container that is completely thermoformed. Additionally, this results in a container that has more features than a container that is completely made of corrugated material. Further, this results in a container that is more easily collapsed and opened than a container that is completely made of corrugated material. Still further, this results in a container with improved stacking and storing qualities as compared to a container that is completely made of corrugated material.

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

The preferred embodiment of the invention is discussed with reference to the figures in which like reference numbers indicate like elements. Furthermore, the leftmost digit of each reference number indicates the number of the figure in which the number is first used. While specific materials and configurations are discussed, it should be understood that this is done for illustration purposes only. A person skilled in the art will recognize that other materials and configurations may be used without departing from the spirit and scope of the present invention.

Figures 1, 1A:
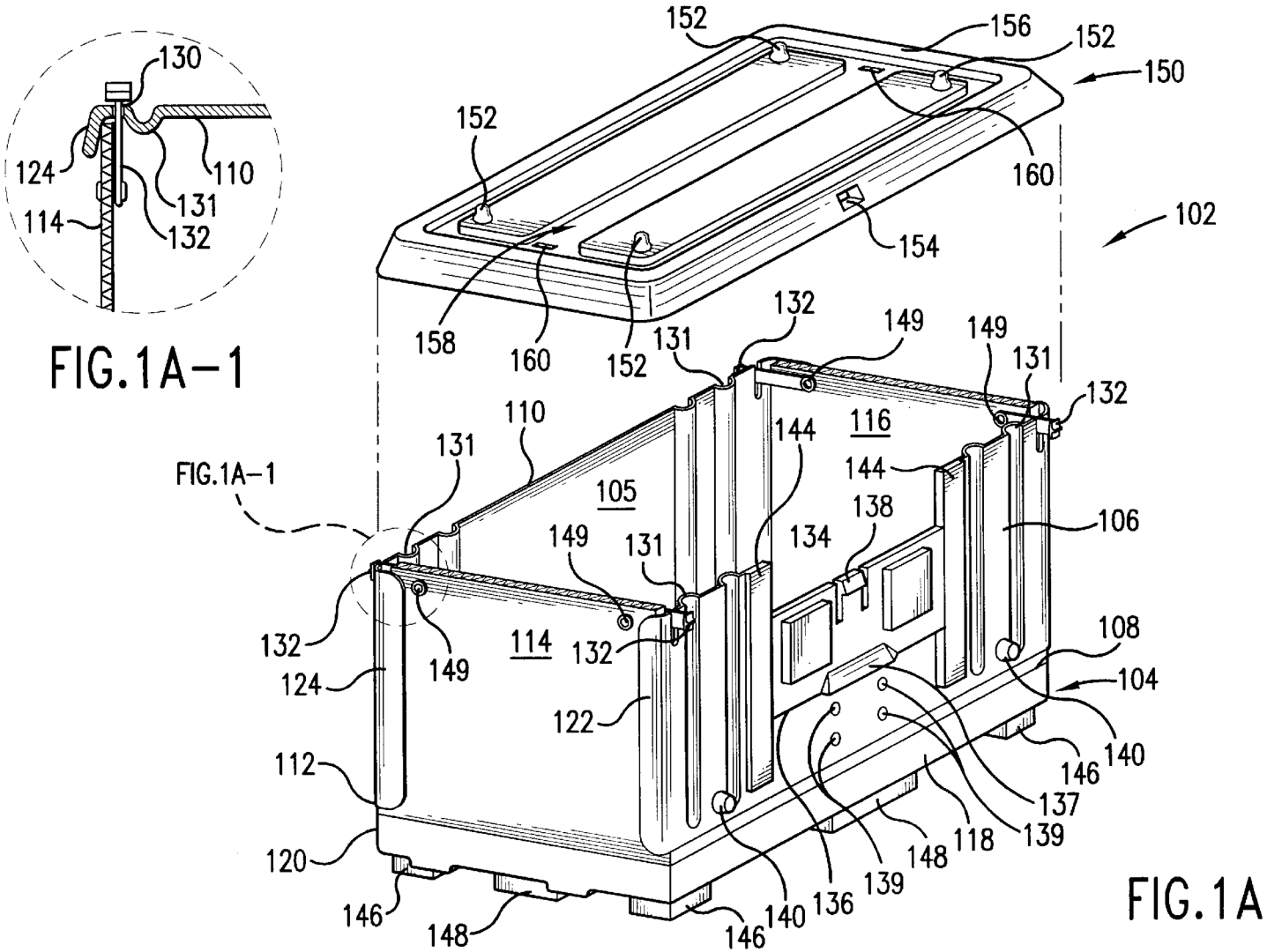
FIG. 1A is a perspective view of a collapsible container 102 in an open position, according to a preferred embodiment of the present invention.

The present invention is a collapsible container. The collapsible container 102 constructed in accordance with a preferred embodiment of the present invention is illustrated in FIG. 1A. Collapsible container 102 includes a substantially rectangular plastic base 104, a first plastic wall 106, a second plastic wall 110, a first corrugated wall portion 114, and a second corrugated wall portion 116. Each plastic wall 106 and 110 and each corrugated wall portion 114 and 116 are substantially rectangular in shape and together with plastic base 104 define an inner storage area 105, when container 102 is in an open position (as shown in FIG. 1A). It is noted that the term rectangular is meant to also encompass a shape that is square.

In one embodiment, when container 102 is in the open position it is approximately 48 inches wide (i.e., the length of each plastic wall 106, 110 is approximately 48 inches), 40 inches deep (i.e., the length of each corrugated wall portion 114, 116 is approximately 40 inches), and 38 inches high (i.e., the height of base 104 plus one of walls 106, 110, 114 or 116 is approximately 38 inches). Of course, a collapsible container 102 of other dimensions is within the spirit and scope of the present invention.

First plastic wall 106 is coupled by a first hinge 108 to a first edge 118 of plastic base 104. Similarly, second plastic wall 110 is coupled by a second hinge 112 to a second edge 120 of plastic base 104. In one embodiment, described in more detail below, first and second hinges, 108, 110, are integrally formed "living" hinges. In an alternative embodiment, first and second hinges 108 and 110 are non-integrally formed hinges.

First corrugated wall portion 114 is positioned between and adjacent to first plastic wall 106 and second plastic wall 110. Second corrugated wall portion 116 is positioned between and adjacent to first plastic wall 106 and second plastic wall 110, and is opposite first corrugated wall 114. When container 102 is in the open position, first corrugated wall portion 114 mates with a first lip 122 of first plastic wall 106 and a first lip 124 of second plastic wall 110. Similarly, when container 102 is in the open position, second corrugated wall portion 116 mates with a second lip 126 (shown in FIG. 1B) of first plastic wall 106 and a second lip 128 (shown in FIG. 1B) of second plastic wall 110. Lips 122 and 126 are preferably integrally formed with first plastic wall 106. Lips 124 and 128 are preferably integrally formed with second plastic wall 110. Lips 122, 124, 126 and 128 prevent corrugated wall portions 114 and 116 from folding, outward when container 132 is in the open position.

Figure 1B:
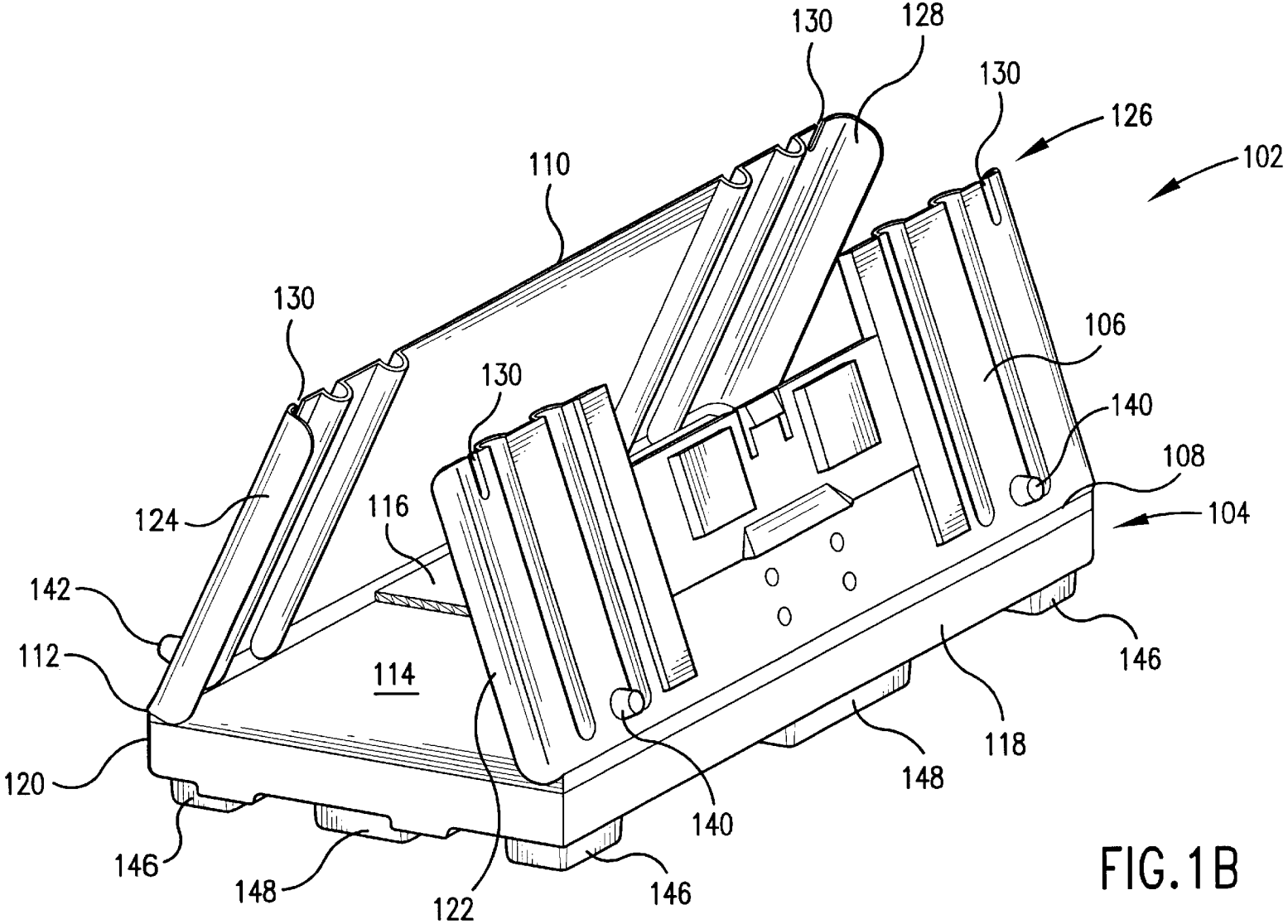
FIG. 1B is a perspective view of the collapsible container 102 of FIG. 1A in a partially collapsed position.
Figure 2A:
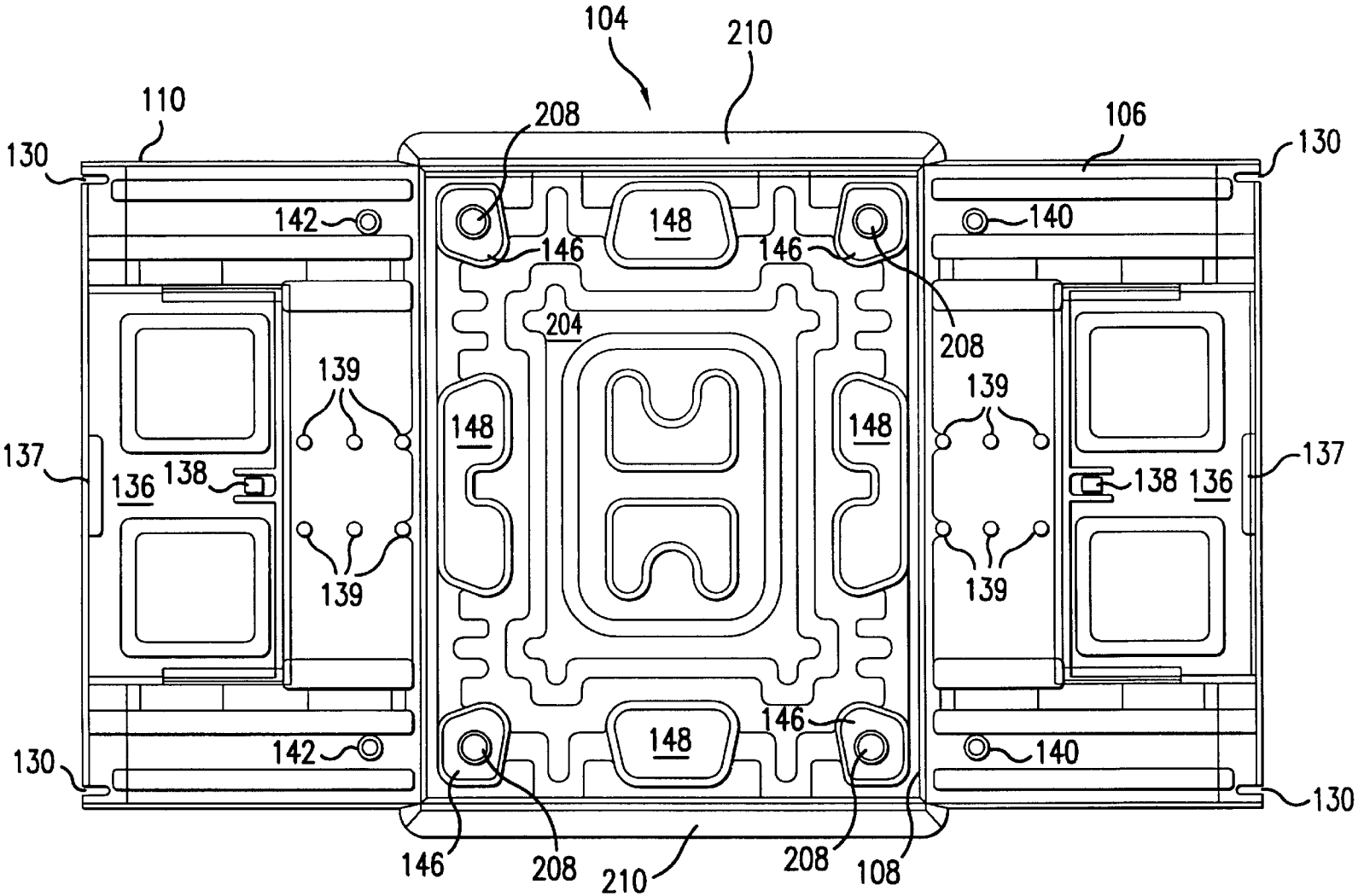
FIG. 2A is a top view of plastic base 104 and first and second plastic walls 106, 110, folded out away from base 104, according to an embodiment of the present invention.

First plastic wall 106 and second plastic wall 110 preferably have a slot 130 in each corner that is distal from base 104 (as shown in FIGS. 1A, 1B and 2A). A lever 132 is pivotally attached, using rivets 149, to each corner of corrugated wall portions 114 and 116 that is distal from base 104 (as shown in FIGS. 1A, 3B and 9D). Each lever 132 is positioned to pivotally engage with a corresponding slot 130 in one of plastic walls 106, 110, to thereby secure each corrugated wall portion 114, 116 to an adjacent plastic wall 106, 110. This is shown in detail in the mangified portion of FIG. 1A and in FIG. 9D. When engaged with slots 130, levers 132 prevent corrugated wall portions 114 and 116 from folding in toward base 104. Corrugated wall portions 114 and 116 prevent plastic walls 106 and 110 from folding inward toward base 104. When levers 132 are engaged with slots 130, levers 132 prevent plastic walls 106 and 110 from folding outward. Additionally, when levers 132 are engaged with slots 130, levers 132 prevent corrugated walls 114, 116 from folding inward toward base 104.

Preferably, each slot 130 is located at a specific distance from its adjacent lip (122, 126, 124 or 128), the distance being approximately the thickness of a corrugate wall portion 114, 116 (as shown in the mangified portion of FIG. 1A). This keeps corrugated wall portions 114 and 116 snug against lips 122, 126, 124 and 128 of plastic walls 106 and 110.

In one embodiment, plastic walls 106 and 110 includes ribs that increase the strength of the walls. In this embodiment, a rib 131 is preferably located adjacent to each slot 130, on a side of slot 130 that is opposite the corresponding lip 122, 126, 124 or 128 (as shown in the magnified portion of FIG. 1A). Each rib 131, together with one of lips 122, 126, 124 and 128, forms a channel in which outer edges of corrugated wall portions 114 and 116 rest when container 102 is in the open position. This increases the structural rigidity of container 102 when in the open position. Further, when levers 132 are engaged with slots 130, ribs 131 assist levers 132 in preventing corrugated wall portions 114 and 116 from folding inward toward base 104.

Figure 1C:
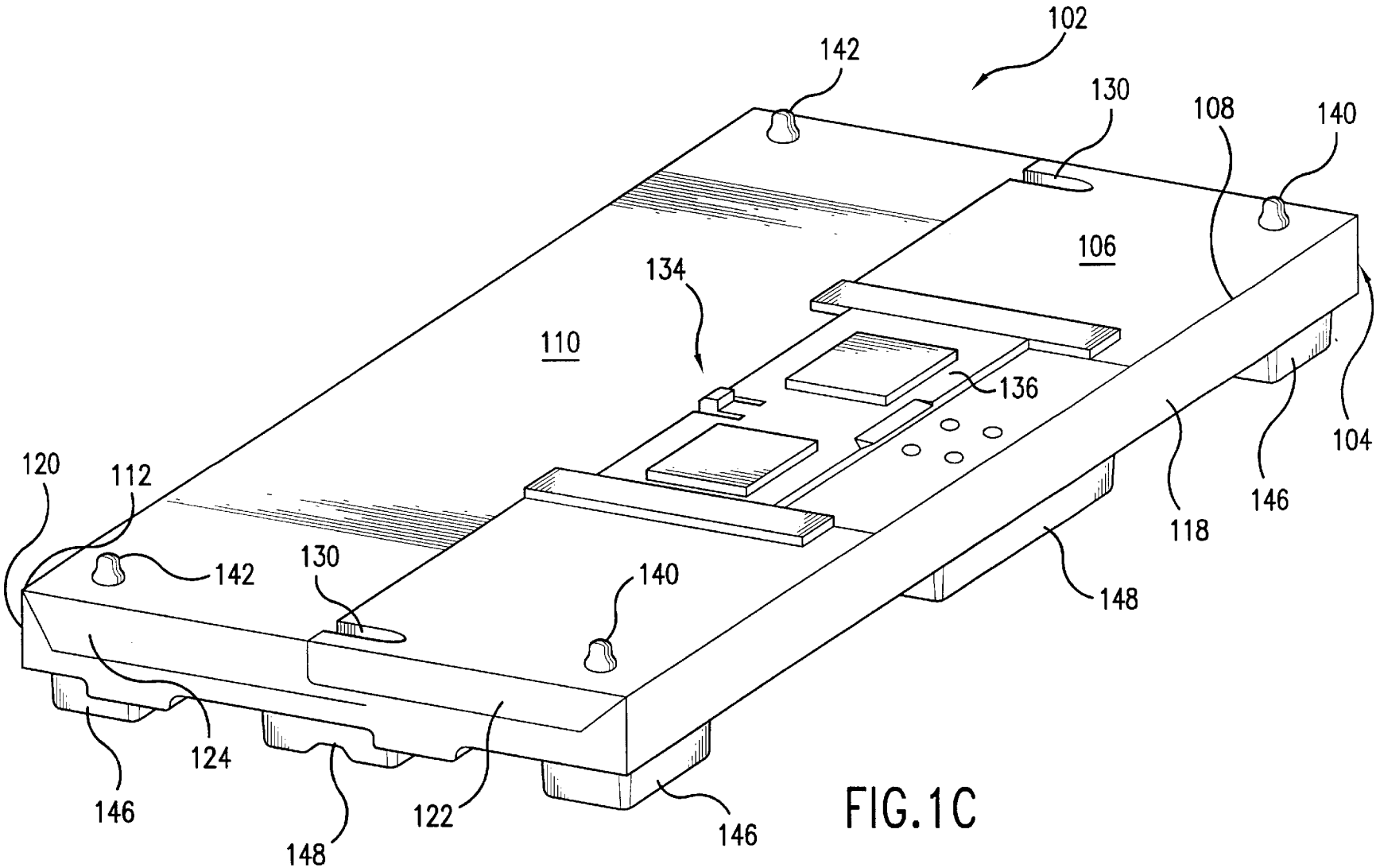
FIG. 1C is a perspective view of the collapsible container 102 of FIGS. 1A and 1B in a collapsed position.

When levers 132 are pivotally disengaged from slots 130 of plastic walls 106 and 110, corrugated wall portions 114 and 116 can be folded inward toward base 104. After corrugated wall portions 114 and 116 are folded completely down (i.e., completely in) toward base 104, then plastic walls 106 and 110 can also be folded in toward base 104, as shown in FIG. 1B. FIG. 1C shows all four walls (114, 116, 106 and 110) folded in toward base 104.

Figure 9C:
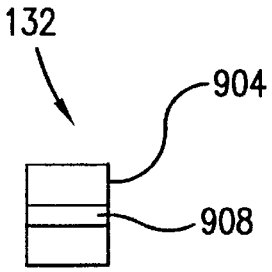
FIGS. 9A, 9B and 9C, are, respectively, a side view, a top view, and a front view of one of levers 132 according to a preferred embodiment of the present invention.
Figure 9A:
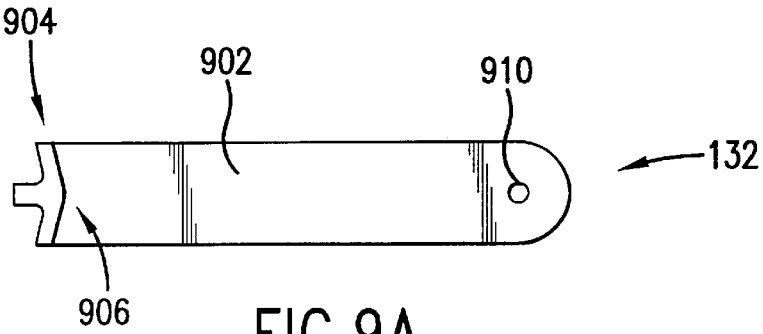
Figure 9B:
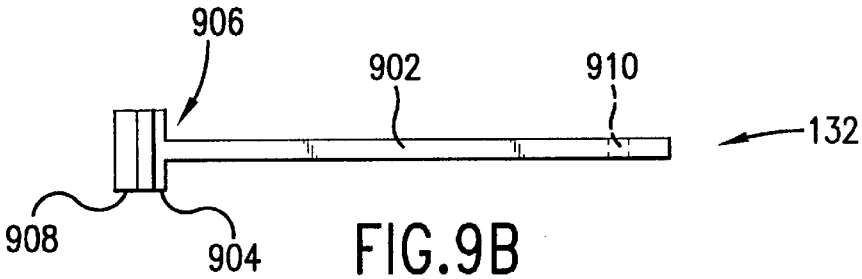
Figure 9D:
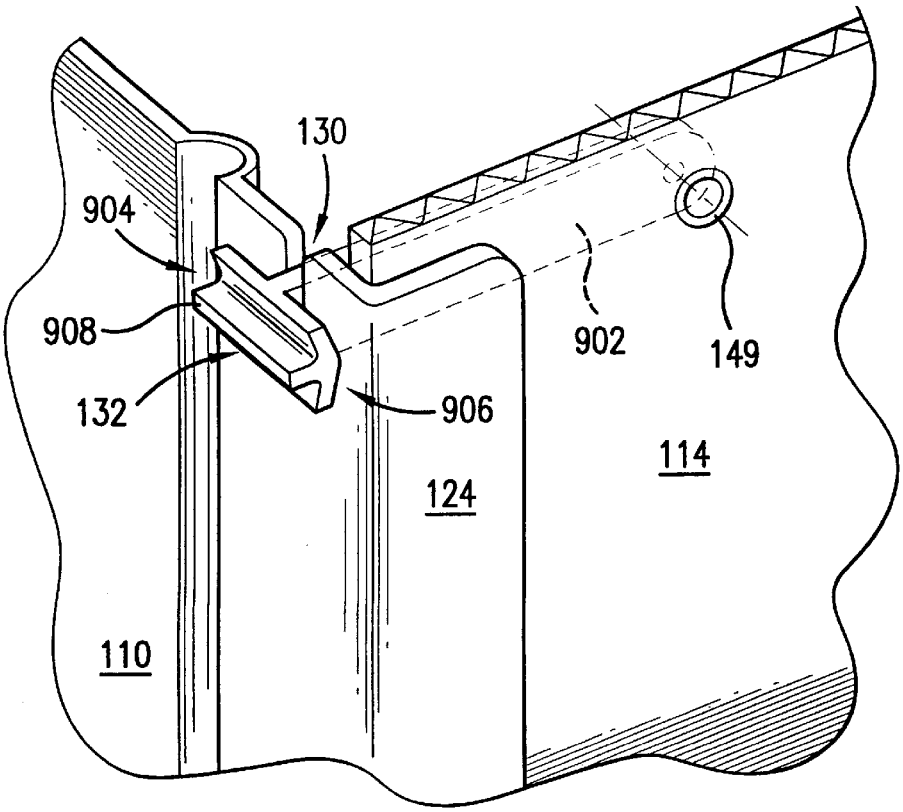
FIG. 9D is a perspective view that shows one of levers 132 engaged with a slot 130 of a second plastic wall 110.

A preferred embodiment of lever 132 is shown in FIGS. 9A, 9B and 9C, which are, respectively, a side view, a top view, and a front view of lever 132. Lever 132 includes a body portion 902 which rests within slots 30. A hole 910 located near one end of body portion 902 is used to pivotally connect levers 132 to corrugated wall portions 114 and 116. A handle 904 is located at an opposite end of body portion 902. A back portion 906 of handle 904 is preferably shaped such that plastic walls 106 and 110 are pushed toward corrugated wall portions 114 and 116 as levers 132 are pivoted into slots 132. FIG. 9D is a perspective view that shows the lever 130 of FIGS. 9A–9C engaged in slot 130 of second plastic wall 110.

In a preferred embodiment, plastic base 104, first plastic wall 106 and second plastic wall 110 are manufactured from a single sheet of material. In such an embodiment, first and second hinges, 108 and 112, are flexible, "living" hinges. The single sheet of material is preferably a thermal plastic material such as polyethylene or polypropylene. Additionally, in a preferred embodiment, plastic base 104 and plastic walls 110 and 106 are thermoformed. In such an embodiment, first and second lips 122, 126 are integrally formed with first plastic wall 106. Similarly, first and second lips 124 and 128 are integrally formed with second plastic wall 110.

Figure 2B:
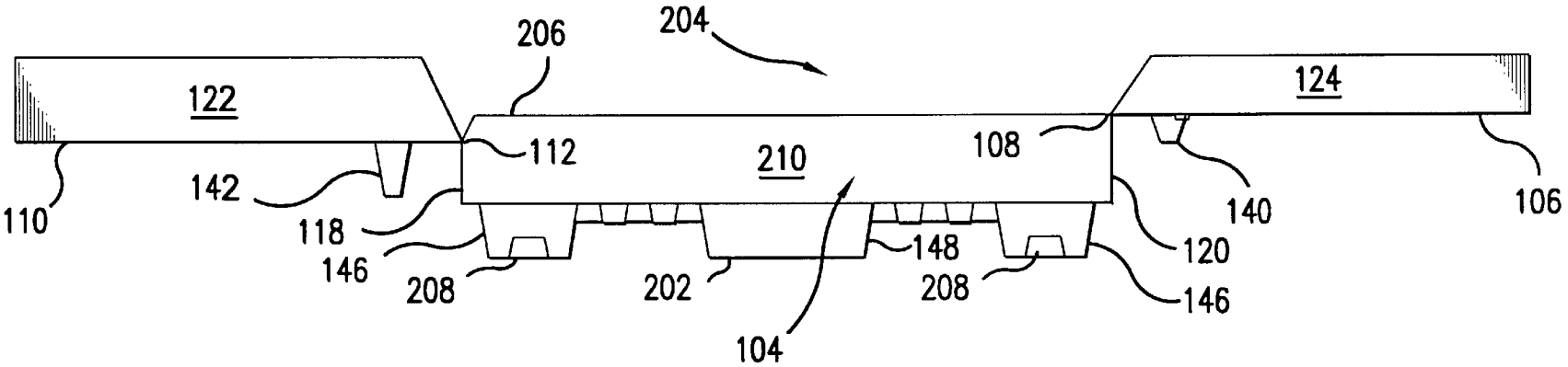
FIG. 2B is a side view of the plastic base 104 and the first and second plastic walls 106, 110, of FIG. 2A.

FIG. 2A is a top view of plastic base 104 and first and second plastic walls 106, 110, folded out away from base 104, according to an embodiment of the present invention. FIG. 2B is a side view of the plastic base 104 and the first and second plastic walls 106, 110, of FIG. 2A. Plastic base 104 preferably includes ribs throughout to strengthen the base. To further increase its structural rigidity, the ribs are preferably arranged such that no straight line exists entirely across the base 104 (as shown in FIG. 2A). Referring to FIGS. 1A–1C and 2A–2B, plastic base 104 also preferably includes an integrally formed foot 146 in each corner and a middle foot 148 that is integrally formed between each pair of corner feet 146. Such an arrangement provides for easy four way entry under container 102 by the forks of a forklift truck.

Plastic base 104 also includes a peripheral rim 210 projecting from its inner surface 204, wherein the first and second hinges 108, 112, are formed at opposite edges of rim 210. Peripheral rim 210 increases the strength of base 104. Additionally, peripheral rim 210 assists in preventing corrugated wall portions 114 and 116 from folding outward away from base 104.

As discussed above, first plastic wall 106, second plastic wall 110 and base 104 are preferably formed from a single sheet of material. Depending on the size of the container to be manufactured, however, it may not be practical to form all three pieces from a single sheet of material. Thus, in an alternate embodiment of the invention, first plastic wall 106, second plastic wall 110 and base 104 are each separately formed. In such an embodiment, hinges 108 and 112 could be formed in walls 106 and 110, respectively, several inches from the lower edge of the wall. The lower side of the hinge could then be attached (e.g., by rivets, thermal bonding and/or an adhesive) to an edge (e.g., edge 118 or edge 120) of base 104. Alternatively, the lower side of the hinge could be attached directly to inner surface 204 of base 104, inside of edges 118, 120. Such modifications would be apparent to a person skilled in the art based on the present disclosure.

In the alternate embodiment described above where the plastic walls and base are separately formed, different materials or material thicknesses can be used for walls 106, 110 and base 104. This would permit, for example, a stiffer material to be used for walls 106, 110. In addition, different walls heights could be manufactured for use with a common base. Moreover, materials of different colors could be used for the walls to implement color-coding schemes and aid container identification. In yet another embodiment, different colored doors (e.g., door 136, discussed below) on sides 106, 110 could be used to implement a color-coding scheme.

Figure 3A:
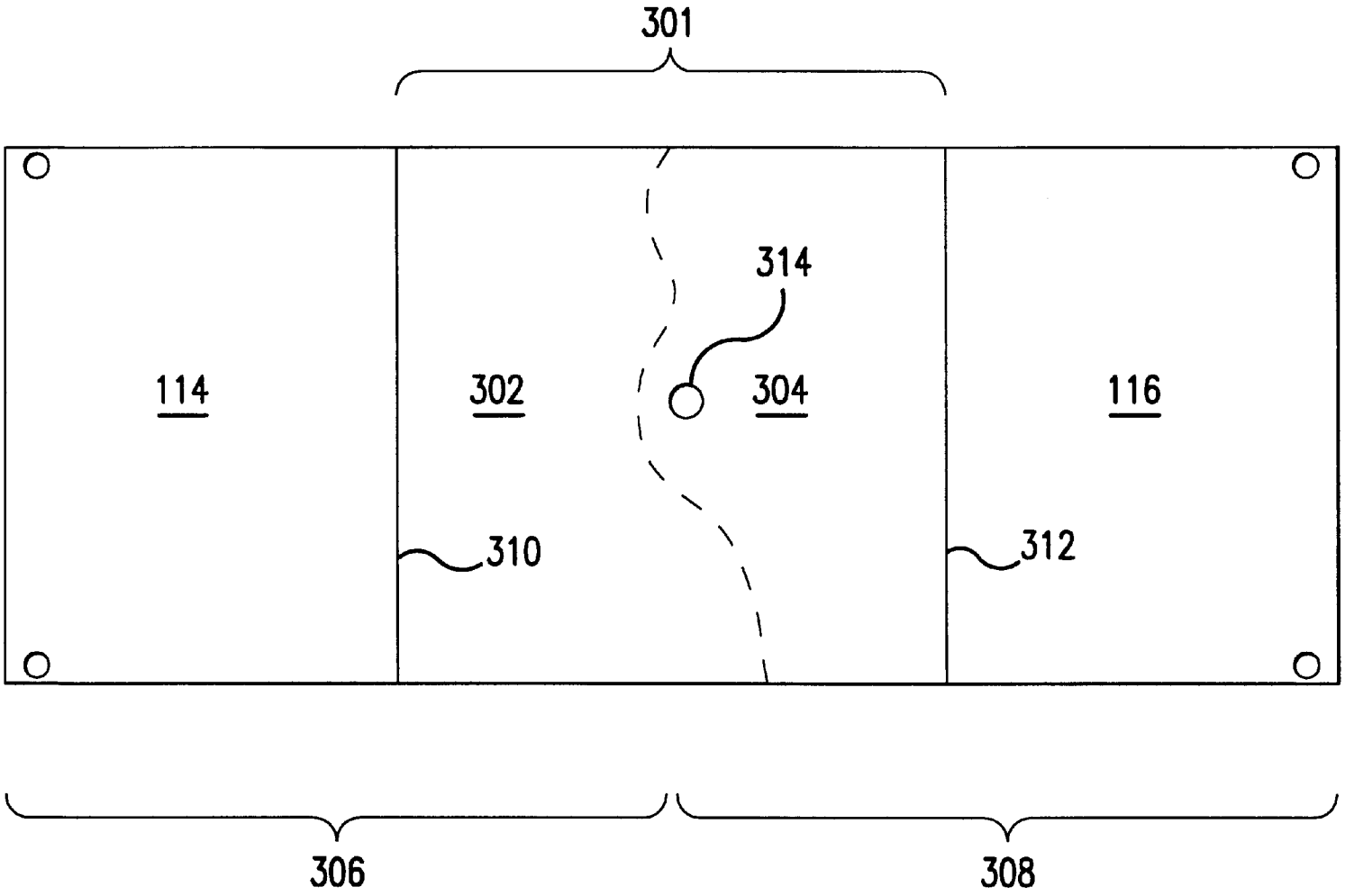
FIG. 3A is a top view of a corrugated sheet that is used in an embodiment of the present invention where a first corrugated wall portion 114, a corrugated floor 301, and a second corrugated wall portion 116 comprise a single sheet of corrugated material folded along lines 310 and 312.
Figure 3B:
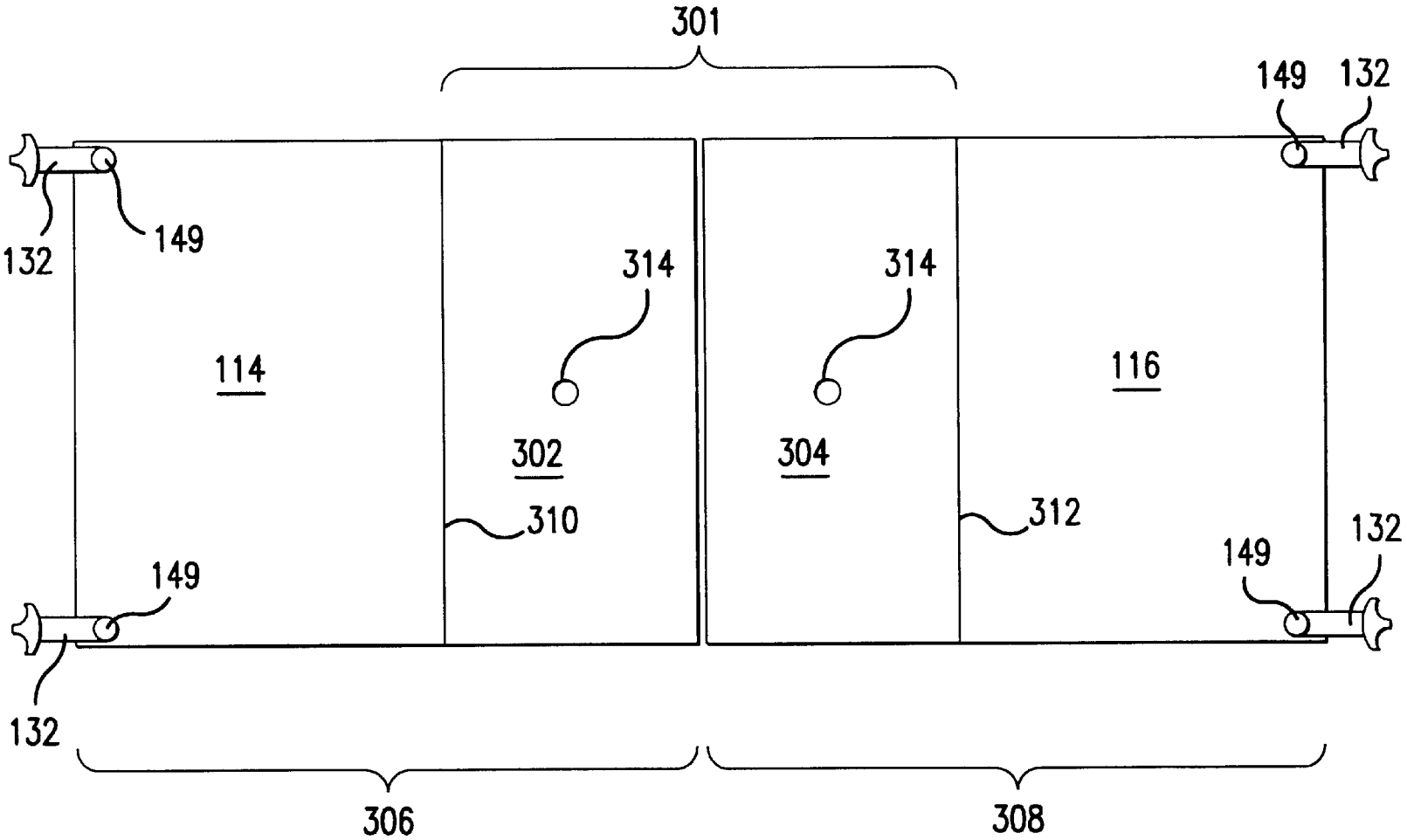
FIG. 3B is a top view of two corrugated sheets that are used in an embodiment of the present invention where first corrugated wall portion 114 and a first corrugated floor portion 302 comprise a first sheet of corrugated material folded along line 310, and second corrugated wall portion 116 and a second corrugated floor portion 304 comprise a second sheet of corrugated material folded along line 312.

Turning to FIG. 3A, a first corrugated element 306 is folded along line 310 to form a first corrugated floor portion 302 and first corrugated wall portion 114. Similarly, a second corrugated element 308 is folded along line 312 to form a second corrugated floor portion 304 and second corrugated wall portion 116. The first and second corrugated floor portions 302, 304, rest on base 104 to form a corrugated floor 301. In one embodiment, first corrugated element 306 and second corrugated element 308 are formed from a single sheet of corrugated material, as depicted in FIG. 3A. In this embodiment, first corrugated floor portion 302 and second corrugated floor portion are contiguous. In other words, in this embodiment corrugated floor 301, first corrugated wall portion 114, and second corrugated wall portion 116 are manufactured from a single sheet of corrugated material that is folded along lines 310 and 312. Corrugated floor 301, which is made Up of first corrugated floor portion 302 and second corrugated floor portion 304, preferably includes at least one or more holes 314, through which an attaching means can attach corrugated floor 301 (and thus corrugated elements 306 and 308) to base 104. First corrugated element 306 is attached to base 104 so that first corrugated wall portion 114 is positioned between and adjacent first and second plastic walls 106. Second corrugated element 308 is attached to base 104 so that second corrugated wall 116 is positioned between and adjacent first and second plastic walls, 106 and 110, and opposite first corrugated wall portion 114. In this embodiment, where first and second corrugated elements 306 and 308 are manufactured from a single sheet of corrugated material, both first and second corrugated elements can be attached to base 104 by the same attaching means (e.g., a plastic rivet).

It is noted that almost the entire collapsible container 102 can be manufactured from two pieces of material in an embodiment where first and second corrugated wall portions 114, 116, and corrugated floor 301 are made from a single sheet of corrugated material (i.e., first corrugated element 306 and second corrugated element 308 are manufactured from a single sheet of corrugated material), and plastic base 104, and first and second plastic walls 106, 110, are made of a single piece of plastic material.

Depending on the size of container 102, it may be difficult to manufacture a single sheet of corrugated material that is large enough to make up corrugated floor 301 and corrugated wall portions 114 and 116. Accordingly, as illustrated in FIG. 3B, first corrugated element 306 and second corrugated element 308 can be separate sheets of corrugated material. In this embodiment, first corrugated element 306 is folded along line 310 to form first corrugated floor portion 302 and first corrugated wall portion 114. Similarly, second corrugated element 308 is folded along line 312 to form second corrugated floor portion 304 and second corrugated wall portion 116. In this embodiment, first corrugated floor portion 302 and second corrugated floor portion 304 are adjacent one another and rest on base 104 to form corrugated floor 301. First corrugated floor portion 302 includes at least one hole 314 that enables an attaching means (e.g., a plastic rivet) to attach first corrugated floor portion 302 (and thus, first corrugated element 306) to base 104. Similarly, second corrugated floor portion 304 includes at least one hole 314 that enables an attaching means (e.g., a plastic rivet) to attach second corrugated floor portion 304 (and thus second corrugated element 308) to base 104. First corrugated element 306 is attached to base 104 so that first corrugated wall portion 114 is positioned between and adjacent first and second plastic walls 106. Second corrugated element 308 is attached to base 104 so that second corrugated wall 116 is positioned between and adjacent first and second plastic walls, 106 and 110, and opposite first corrugated wall portion 114.

As mentioned above, base 104 preferably includes ribs throughout to increase its strength, as shown in FIG. 2A. This results in base 104 having an inner surface 204 that is not-flat (i.e., due to the ribs). Preferably, inner storage area 105 includes a flat surface on which contents, which may or may not be individually boxed, can rest. Corrugated floor 301, which rests on inner surface 204 of base 104 (as described above), provides the desired flat surface within inner storage area 105. Additionally, corrugated floor 301 increases the overall strength of base 104. Corrugated floor 301 also distributes the weight of the contents over a (greater portion of base 104.

In one embodiment, where first corrugated element 306 and second corrugated element 308 are manufactured from separate sheets of corrugated material, first corrugated element 306 and second corrugated element 308 are substantially identical and thus interchangeable. This is important during assembly of collapsible container 102, in that there can be no confusion as to which corrugated element should be attached to a particular part (e.g., side) of base 104.

In one embodiment, corrugated elements 306 and 308 are manufactured from sheets of corrugated cardboard. The corrugated cardboard is preferably at least double walled. To strengthen collapsible container 102, the corrugated elements 306 and 308 can be manufactured from triple wall corrugated cardboard. In an alternative embodiment, corrugated elements 306 and 308 are made from corrugated plastic, which is preferably at least double walled. It is the corrugated elements 306 and 308 that give collapsible container 102 a majority of its strength when weight is applied in a direction perpendicular to base 104 (e.g., when a substantially identical container is stacked on top of collapsible container 102).

In a preferred embodiment, corrugated elements 306 and 308 are replaceable. That is, corrugated elements 306 and 308 can be detached from base 104 and replaced with new corrugated elements 306 and 308. This can increase the useful life of collapsible container 102 if corrugated element 306 and 308 begin to weaken prior to the other elements of collapsible container 102.

Figure 6C:
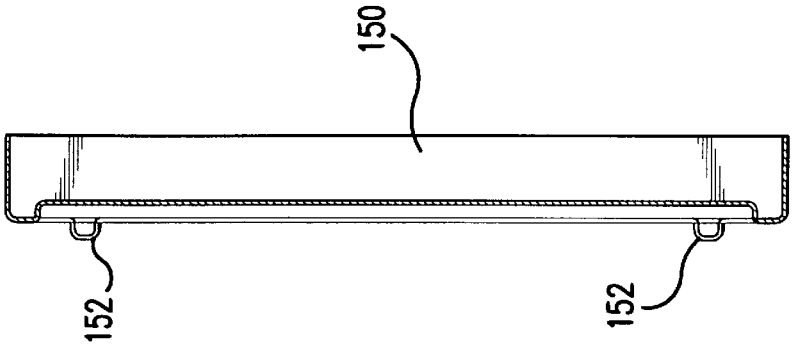
FIGS. 6A, 6B and 6C are, respectively, a top view, a first side view, and a second side view, of a lid 150, according to an embodiment of the present invention.
Figure 6B:
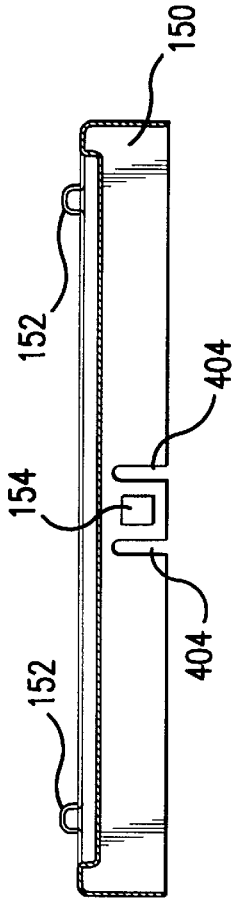
Figure 6A:
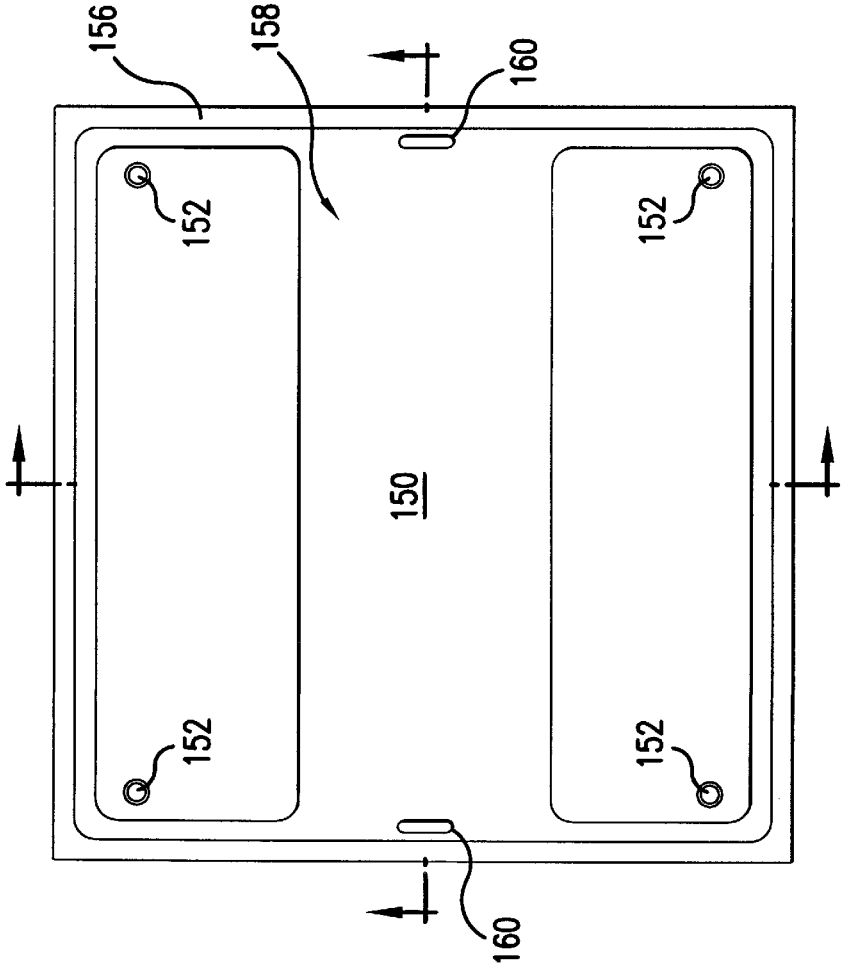

Referring to FIG. 1A, collapsible container 102 preferably includes a substantially rectangular removable plastic lid 150 that can rest along an outer peripheral edge of container 102 when container 102 is in the open position. This outer peripheral edge of container 102 consists of the edges of walls 106, 110, 114 and 116, that are distal from base 104. Lid 150 can also rest over and on peripheral rim 210 when container 102 is in the collapsed position. Different perspectives of lid 150, according to an embodiment of the present invention, are shown in FIGS. 6A–6C. More specifically, FIGS. 6A, 6B and 6C show, respectively, a top view, a first side view, and a second side view, of lid 150.

Importantly, if one or more containers 102 in the collapsed position are stored outside with lids 150 resting on peripheral rims 210, lids 150 keep corrugated elements 306 and 308 dry.

Figure 8:
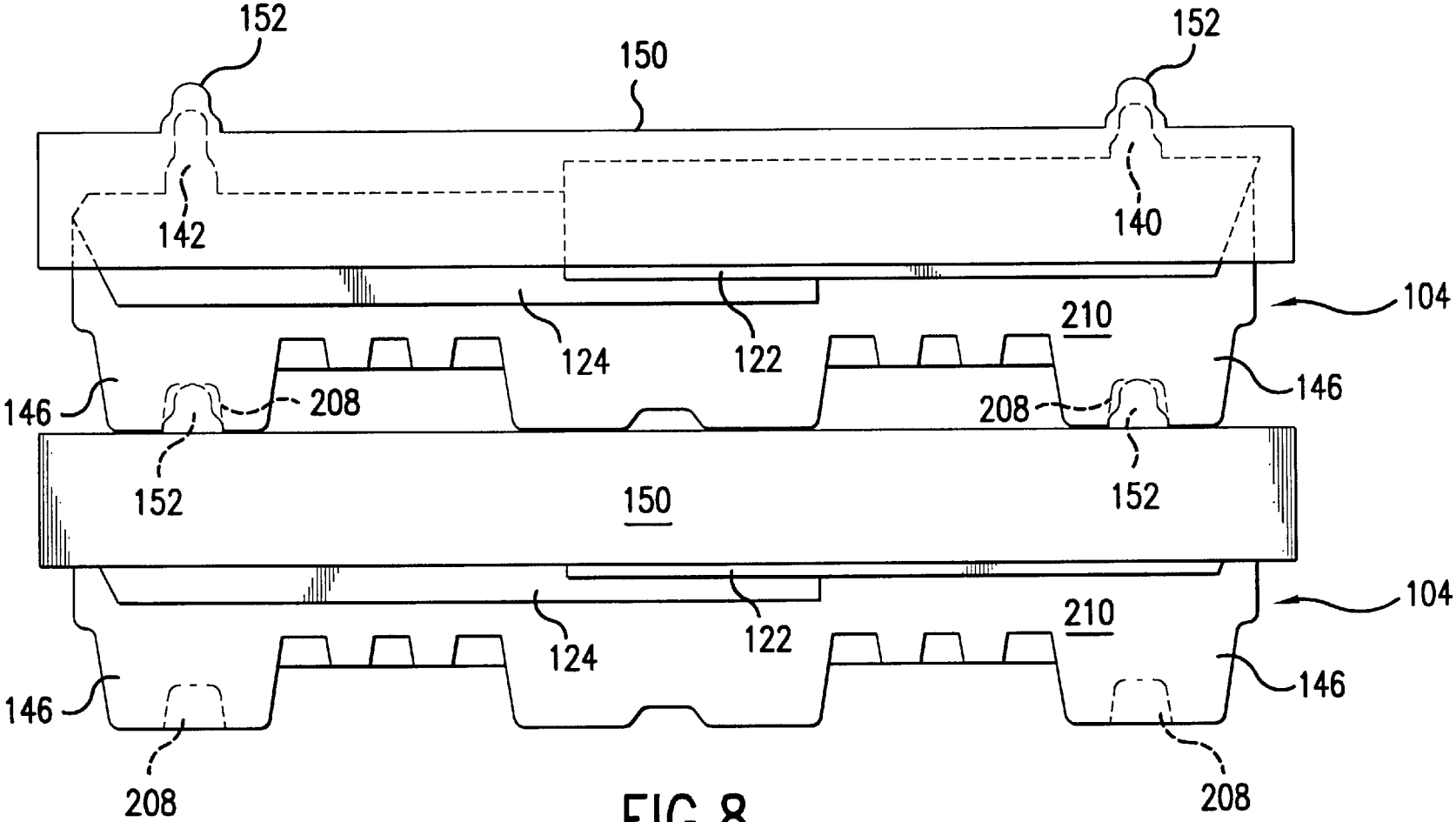
FIG. 8 is a side view of two collapsible containers 102, in the collapsed position, stacked one on top of the other.

For increased strength and rigidity, lid 150 can include ribs. In one embodiment, an outer rib 156 forms a well 158 on an upper surface of lid 150, as shown in FIGS. 1A and 6A. One or more drain holes 160 can be formed in well 158. In a situation where one or more containers 102 in the collapsed position are stored outdoors (with each collapsed container 102 covered by a lid 150, as shown in FIG. 8), drain hole(s) 160 allow rain water to drain out of well 158 without getting corrugated elements 306 and 308 wet. In one embodiment, a surface of well 158 may be slightly slanted to ensure that rain water drains through drain hole(s) 160.

Referring back to FIGS. 2A and 2B, each corner foot 146 includes a detent 208 that aligns with bumps 152 that are formed on lid 150. This enables a plurality of lid 150 covered containers 102 (in the open or closed position) to be effectively stacked.

Figure 5:
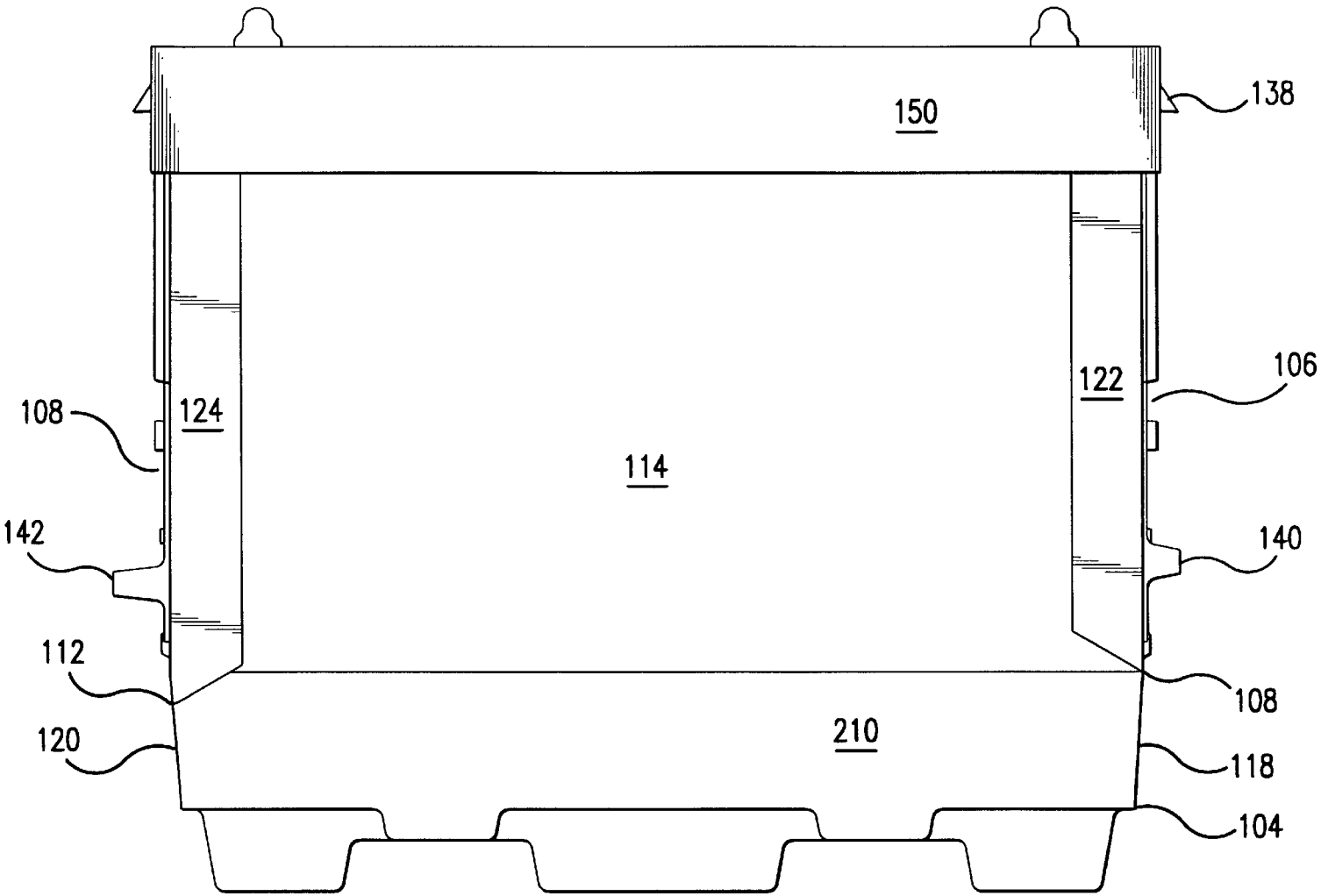
FIG. 5 is a different side view of the collapsible container 102 of FIGS. 1A, 1B and 1C, illustrating corrugated wall portion 114.
Figure 7:
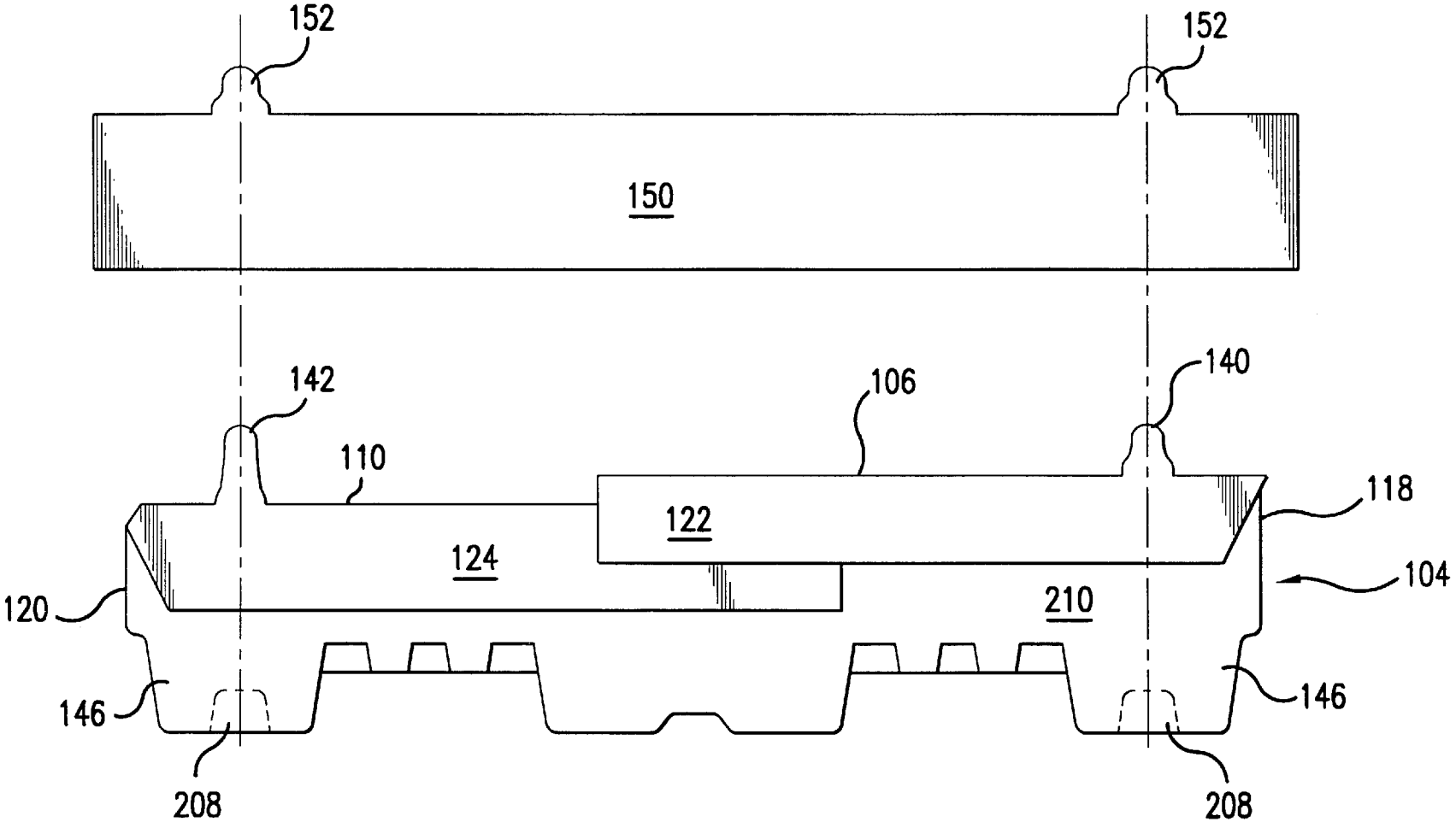
FIG. 7 is a side view of the collapsible container 102 in the collapsed position.

In a preferred embodiment, first plastic wall 106 includes a first pair of bumps 140 (one near each of its corners that are proximal to first hinge 108), and second plastic wall 110 includes a second pair of bumps 142 (one near each of its corners that are proximal to second hinge 112). When container 102 is in the open position, as shown in FIGS. 1A and 5, first pair of bumps 140 and second pair of bumps 142 (which can not be seen in FIG. 1A), protrude in a direction outward from interior storage area 105. When container 102 is in the collapsed position, as shown in FIGS. 1C and 7, first and second pair of bumps, 140 and 142, extend in a direction that is outward from inner surface 204 of base 104 (in other words, in a direction substantially perpendicular to corrugated floor 301). Four detents in an underside of lid 150, which are formed by bumps 152, substantially align with first and second pair of bumps, 140, 142, when collapsible container 102 is in the collapsed position, as shown in FIG. 7 (which is a side view of collapsible container 102 in the collapsed position as shown in FIG. 1C). This allows first and second pair of bumps, 140 and 142, to rest at least partially within the detents in the underside of lid 150, when container 102 is in the collapsed position, as shown in FIG. 8. This also enables multiple lid 150 covered containers 102 in the collapsed position to be effectively stacked, as shown in FIG. 8. Note that when container 102 is in the collapsed position, removable lid 150 covers at least a portion of peripheral rim 210.

Plastic walls 106 and 110 may be of such height that when they are folded in toward base 104, one of the folded-in walls rests on top of the other folded-in wall. For example, as shown in FIGS. 1C, 7 and 8, when second plastic wall 110 is folded-in first, folded-in first plastic wall 106 rests on top of folded-in second plastic wall 110. In this situation, it is preferable that a first hinge 108 is along a higher plane than a second hinge 112, so that when container 102 is in the collapsed position and second plastic wall 110 is folded in prior to first plastic wall 106, second plastic wall 110 and first plastic wall 106 are substantially parallel to a supporting surface upon which base 104 rests. In this situation (i.e., where first plastic wall 106 rests on second plastic wall 110, when container 102 is in the collapsed position), it is also preferable that second pair of bumps 142 extend a greater distance from second plastic wall 110 than first pair of bumps 140 extend from first plastic wall 106 (as shown in FIGS. 5 and 7) so that second pair of bumps 142 and first pair of bumps 140 are substantially planer when container 102 is in the collapsed position. Keeping the first and second pair of bumps planer to one another, and also planer to the surface that supports base 104, enables many containers 102 in the collapsed position to be stacked without falling over.

Referring to FIG. 1A, in one embodiment, at least one of plastic walls 106 and 110 includes an opening 134 that provides access to contents within container 102, without removing lid 150. Preferably, a door 136, is slidingly attached to plastic wall 106 and/or 110, such that sliding door 136 can fully or partially restrict access through opening 134. This can be accomplished using channels that are integrally formed along the vertical edges of opening 134. Alternatively, channel members 144 can be attached (e.g., riveted) to plastic wall 106 and/110. The channels can be formed such that sliding door 136 can be removed. Alternatively the channels can be formed such that sliding door 136 cannot be removed, to prevent door 136 from being lost. Plastic walls 106 and/or 110 can include detents 139 that engage with a handle portion 137 of sliding door 136 to assist in keeping sliding door 136 in a desired position (e.g., partially slid down). FIGS. 1A, 1B and 1C show only plastic wall 106 having such an opening 134. FIG. 2A shows both plastic walls 106 and 110 having an opening 134, which is covered by sliding doors 136.

Figure 4:
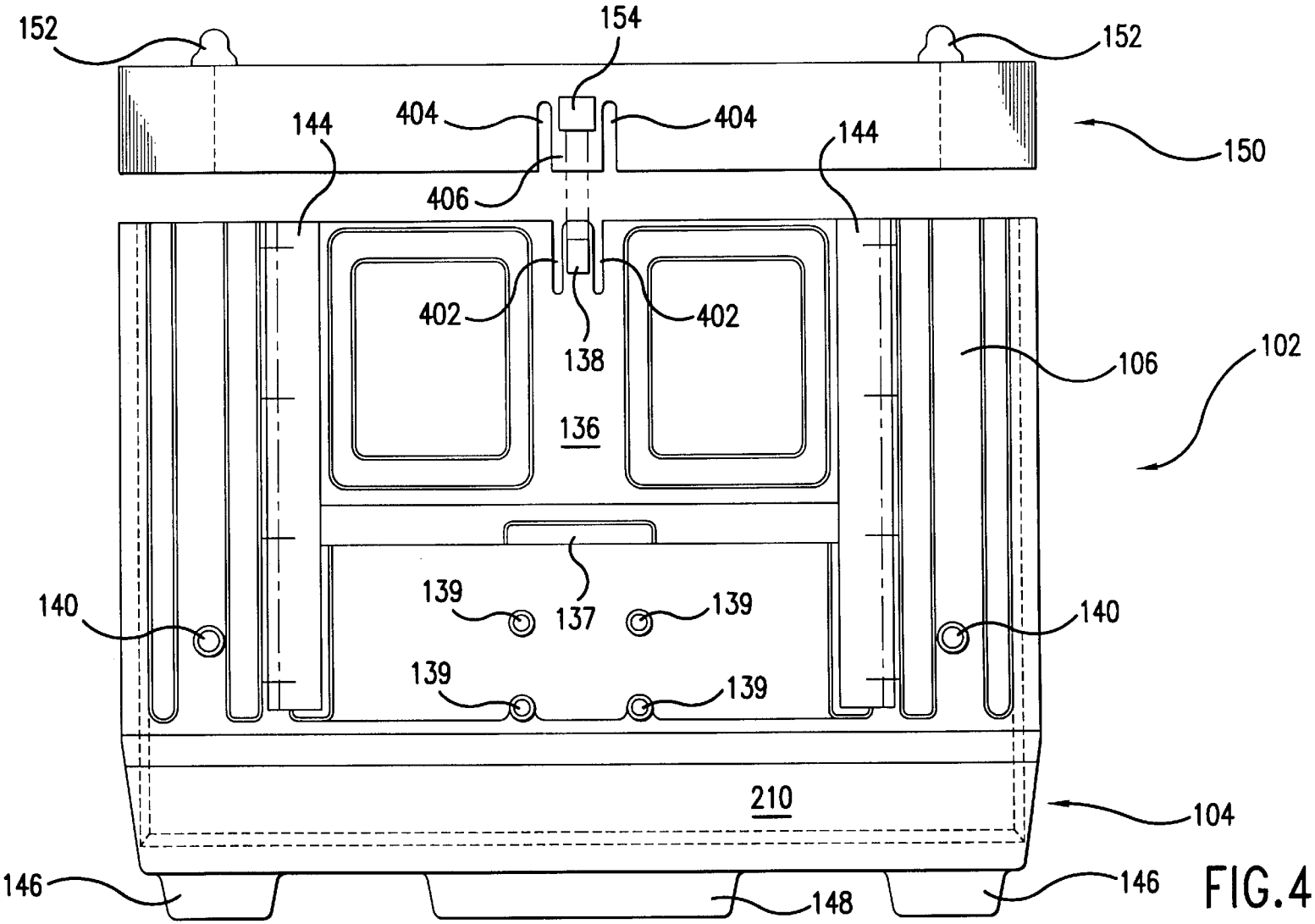
FIG. 4 is a side view of the collapsible container 102 of FIGS. 1A, 1B and 1C, illustrating a plastic side 106.

In one embodiment, sliding door 136 includes a lock bump 138 that extends in a direction outward from container 102. Lock bump 138 is positioned such that when sliding door 136 is closed (i.e., sliding door 136 fully covers opening 134), lock bump 138 is near the outer peripheral edge of container 102, as shown in FIG. 4 (which is a side view of the collapsible container 102 of FIGS. 1A, 1B and 1C, looking at first plastic wall 106). In this embodiment, lid 150 includes a small opening 154 in which lock bump 138 aligns with when lid 150 is placed on the outer peripheral edge of container 102. As shown in FIG. 4, slits 402 are located on either side of lock bump 138 to allow lock bump 138 to bend inward (toward container 102) when lid 150 is being placed on the outer peripheral ridge of container 102. Lock bump 138 then returns to its normal position and protrudes from opening 154, once lid 150 rests firmly on the outer peripheral edge of container 102, thereby locking lid 150 in place. Besides locking lid 150 in place, lock bump 138 also assists in keeping sliding door 136 in the closed position (i.e., fully covering opening 134). Thus, to either remove lid 150 and/or lower (i.e., slide open) sliding door 134 when lock bump 138 protrudes from small opening 154, the portion of lock bump 138 that protrudes from opening 154 should be pushed (i.e., bent) inward.

In an embodiment where container 102 does not include a sliding door 136, lock bump 138 and slits 402 can be located in plastic wall 106 and/or 110.

In another embodiment, slits 404 are located in lid 150 on either side of opening 154, as shown in FIGS. 4 and 6B. When lid 150 is placed on the outer peripheral ridge of container 102, lock bump 138 pushes against a portion 406 of lid 150 that is below small opening 154, thereby causing portion 406 to bend outward (away from container 102). Portion 406 returns to its normal position, and lock bump 138 protrudes from opening 154, once lid 150 rests firmly on the outer peripheral edge of container 102. In this embodiment, slits 402 need not be formed on either sides of lock bump 138.

While the invention has been particularly shown and described with reference to several preferred embodiments thereof, it will be understood by those skilled in the art that various changes in form and details may be made therein without departing from the spirit and scope of the invention as defined in the appended claims.

What is claimed is:

1. A collapsible container comprising:

a substantially rectangular plastic base;

a first plastic wall coupled by a first hinge to a first edge of said base;

a second plastic wall coupled by a second hinge to a second edge of said base opposite said first edge of said base;

a first corrugated element folded to form a first corrugated floor portion and a first corrugated wall portion, said first corrugated floor portion being attached to said base so that said first corrugated wall portion is positioned between and adjacent to said first and second plastic walls, said first corrugated wall portion mating with a first lip of said first plastic wall and a first lip of said second plastic wall; and a second corrugated element folded to form a second corrugated floor portion and a second corrugated wall portion, said second corrugated floor portion being attached to said base so that said second corrugated wall portion is positioned between and adjacent to said first and second plastic walls, and is opposite said first corrugated wall portion, said second corrugated wall portion mating with a second lip of said first plastic wall and a second lip of said second plastic wall.

2. The container of claim 1, wherein, when the container is in a collapsed position, said first and second corrugated wall portions are folded in toward said base, and said first and second plastic walls are folded in toward said base and over said folded-in first and second corrugated wall portions.

3. The container of claim 1, wherein:

said first corrugated element and said second corrugated element are formed from a single sheet of corrugated material, and said first corrugated floor portion and said second corrugated floor portion are contiguous.

4. The container of claim 1, wherein:

said first corrugated element and said second corrugated element are formed from separate sheets of corrugated material, and said first corrugated floor portion is adjacent to said second corrugated floor portion.

5. The container of claim 4, wherein said first corrugated element and said second corrugated element are substantially identical and thus interchangeable.

6. The container of claim 1, wherein said first corrugated element and said second corrugated element comprise corrugated cardboard.

7. The container of claim 1, wherein said first corrugated element and said second corrugated element comprise corrugated plastic.

8. The container of claim 1, wherein said plastic base, said first plastic wall, and said second plastic wall are manufactured from a single sheet of material, and wherein said first and second hinges comprise flexible, living hinges.

9. The container of claim 8, wherein said single sheet of material comprises a thermoplastic material.

10. The container of claim 9, wherein said thermoplastic material comprises polyethylene.

11. The container of claim 9, wherein said thermoplastic material comprises polypropylene.

12. The container of claim 9, wherein said first corrugated element and said second corrugated element comprise corrugated cardboard.

13. The container of claim 12, wherein, when the container is in a collapsed position, said first and second corrugated wall portions are folded in toward said base, and said first and second plastic walls are folded in toward said base and over said folded-in first and second corrugated wall portions.

14. The container of claim 1, wherein said plastic base comprises an outer surface configured to rest on a supporting surface, and an inner surface supporting said first corrugated floor portion and said second corrugated floor portion, said inner surface having a peripheral rim projecting therefrom, wherein said first and second hinges are formed at opposite edges of said rim.

15. The container of claim 1, further comprising:

coupling means, disposed at each corner of the container distal from said base, for coupling an edge of one of said plastic walls to an adjacent edge of one of said corrugated wall portions.

16. The container of claim 15, wherein said coupling means comprises:

a slot in each distal corner of each plastic wall; and a lever pivotally attached to said distal corner of each corrugated wall portion, each lever being positioned to pivotally engage a corresponding slot in one of said plastic walls to secure a corrugated wall portion to an adjacent plastic wall.

17. The container of claim 1, wherein at least one of said first plastic wall and said second plastic wall includes an opening that provides access to contents within the container.

18. The container of claim 17, further comprising a vertically sliding door that can fully or partially restrict access through said opening.

19. The container of claim 1, further comprising a substantially rectangular removable lid that can rest along an outer peripheral edge of the open container to enclose said container.

20. The container of claim 19, wherein, when the container is in a collapsed position, said first and second corrugated wall portions are folded in toward said base, and said first and second plastic walls are folded in toward said base and over said folded-in first and second corrugated wall portions, wherein said plastic base comprises an outer surface configured to rest on a supporting surface, and an inner surface supporting said first corrugated floor portion and said second corrugated floor portion, said inner surface having a peripheral rim projecting therefrom, wherein said first and second hinges are formed at opposite edges of said rim, and wherein when the container is in the collapsed position said removable lid can rest on said first and second folded-in plastic walls and cover at least a portion of said peripheral rim.

21. The container of claim 20, wherein:

said first plastic wall includes a first pair of bumps, one near each corner proximal to said first hinge, said second plastic wall includes a second pair of bumps, one near each corner proximal to said second hinge, wherein when the container is in the open position said first and second pairs of bumps protrude in a direction outward from an interior of the container, wherein when the container is in the collapsed position the first pair of bumps and said second pair of bumps extend in a direction outward from said inner surface of said base, and further comprising:

four detents in an underside of said lid, one near each of its four corners, and wherein when the container is in the closed position and the first and second plastic wall are folded in, said detents substantially align with said first and second pair of bumps such that said first and second pairs of bumps can rest at least partially within said detents when said lid is placed over said folded in first and second plastic walls.

22. The container of claim 21, wherein said second pair of bumps extend a greater distance from said second plastic wall than said first pair of bumps extend from said first plastic wall so that said second pair of bumps and said first pair of bumps are substantially planer when the container is in the closed position and said second plastic wall is folded in prior to said first plastic wall.

23. The container of claim 22, wherein said first hinge of said base is along a higher plane than said second hinge of said base so that when the container is in the collapsed position and said second plastic wall is folded in prior to said first plastic wall, said second plastic wall and said first plastic wall are substantially parallel to a surface supporting said base, and said first and second pair of bumps extend substantially perpendicular to said the surface supporting said base.

24. The container of claim 23, wherein said detents in said underside of said lid cause corresponding bumps in a topside of said lid, and said base includes a foot in each of its four corners, each of said four feet including a detent.

25. The container of claim 24, wherein said detents in said feet of said base substantially align with bumps on a topside of a first lid of a first substantially identical container, and said bumps in said topside of said lid substantially align with detents in feet of a second base of a second substantially identical container, thereby enabling the container to be effectively stacked when it is in the collapsed position or the open position.

26. The container of claim 19, wherein said removable lid includes a peripheral rim that forms a well on an upper surface of said lid, wherein said well includes a drain hole that enables liquid to drain out of said well, said drain hole being near an edge of said lid, and wherein when the container is in the collapsed position and said removable lid rests on said first and second folded-in plastic walls, said drain hole enables liquid to drain out of said well without getting said corrugated elements wet.

* * * * *